US005228418A

United States Patent [19]

Doehring

[11] Patent Number: 5,228,418

[45] Date of Patent: Jul. 20, 1993

[54] TAPPET FOR A VALVE IN AN INTERNAL COMBUSTION ENGINE

[75] Inventor: Klaus Doehring, Heidelberg, Fed. Rep. of Germany

[73] Assignee: Firma Carl Freudenberg, Weinheim/Bergstrasse, Fed. Rep. of Germany

[21] Appl. No.: 868,613

[22] Filed: Apr. 14, 1992

[30] Foreign Application Priority Data

May 28, 1991 [DE] Fed. Rep. of Germany ..... 4117425

[51] Int. Cl.[5] ..... F01L 1/16

[52] U.S. Cl. ..... 123/90.51; 74/569

[58] Field of Search ..... 123/90.48, 90.51, 90.55; 74/569

[56] References Cited

U.S. PATENT DOCUMENTS 3,545,415 12/1970 Mori ..... 123/90.51
4,430,970 2/1984 Holtzberg et al. ..... 123/90.51
4,768,476 9/1988 Behnke et al. ..... 123/90.51
4,873,150 10/1989 Doi et al. ..... 123/90.51
4,876,996 10/1989 Mayer et al. ..... 123/90.51
4,909,198 3/1990 Shiraya et al. ..... 123/90.51
4,924,825 5/1990 Speil ..... 123/90.55

FOREIGN PATENT DOCUMENTS 153912 9/1982 Japan ..... 123/90.51
185913 10/1983 Japan ..... 123/90.51
210308 12/1983 Japan ..... 123/90.51

*Primary Examiner*—E. Rollins Cross
*Assistant Examiner*—Weilun Lo
*Attorney, Agent, or Firm*—Sprung Horn Kramer & Woods

[57] ABSTRACT

A tappet for a valve in an internal combustion includes an essentially cup-shaped housing. The housing fits over the shaft of the valve. At least some of the tappet housing is made of a plastic polymer. At least one annular guide made of wear-resistant material surrounds the housing to protect the tappet against wear.

13 Claims, 4 Drawing Sheets

TAPPET FOR A VALVE IN AN INTERNAL COMBUSTION ENGINE

BACKGROUND OF THE INVENTION

Invention concerns a tappet for a valve in an internal combustion engine and comprises an essentially cup-shaped housing that fits over the shaft of the valve.

Cup-shaped tappets of this kind are generally known. Some are open and may or may not have hydraulic clearance compensation. Others are closed and have such compensation. Examples are disclosed in the German Patent Publication No. OS 3,506,730. Since the housings are metal, they confront the valve-activating mechanisms with a considerable accelerated mass. Accelerated mass is a highly critical parameter which the mass of the tappet participates in directly. The tappet's comparatively high mass subjects the valve mechanism, especially the spring, to inordinately high stress, especially at high speeds. Again, wear and tear in the vicinity of the tappet guides and at the bottom of the housing, where it comes into contact with the cam, increases with the accelerated mass of the valve mechanism.

SUMMARY OF THE INVENTION

The principal object of the present invention is to provide an improved tappet of the aforesaid type, either open and with or without hydraulic clearance compensation or closed and with hydraulic clearance compensation. Advantageously, the improved tappet will have a low enough mass to decrease both the stress on the valve mechanism and wear in the vicinity of the tappet guides and on the bottom of the tappet housing. As a result, the improved tappet will have better operating properties and longer life.

This object, as well as other objects which will become apparent from the following discussion, are attained, in accordance with the present invention, by the improvement wherein at least some of the tappet housing is made of a plastic polymer. Depending upon the shape of the tappet housing and on how much polymer it contains, the mass of any cup-shaped tappet can be definitely decreased. A lower mass will result either in less force and hence less wear at the same acceleration or in increased acceleration of the tappet and its adjacent valve at the same force. The combustion chambers will take in more fuel and the engine will operate more efficiently.

The radially external surfaces of the tappet housing, which rub against the bore that accommodates the housing in the cylinder head, is particularly subject to wear and tear. The tappet housing of plastic polymer may be cost-effective but it is not very resistant to wear. According to the invention, the tappet housing is surrounded by at least one annular guide which is made of a highly wear-resistant material. The housing can also be provided with plasma coated radial and/or axial friction surfaces. This measure will protect the particularly sensitive surfaces of the tappet housing against wear without significantly increasing its mass. As used herein, the term "plasma coating" is intended to denote a coating of metal or ceramic material which is deposited at very high temperatures on the housing surfaces in a spray discharge process.

When the tappet valve shaft acts directly against the base of the housing, care must be taken to ensure that the base, which is the component that encounters the cam, is attached to the housing's hollow counteracting cylindrical component in such a way that it can transmit both push and pull. The base is pushed from outside by its adjacent cam to displace the tappet axially and open the valve. The base is pulled from inside when the spring that conventionally extends between the cylinder head and the tappet housing closes the adjacent valve. The housing can be in two parts axially demarcated by a metal or ceramic base. Metal and ceramic are particularly distinguished by their high resistance to wear and their low heat expansion.

The tappet housing can have an annular guide around it at least one point. The advantage is that high-quality, wear-resistant, and hence usually expensive materials will be reserved for places where wear makes them really necessary. The main part of the tappet can be made of a light weight and cost effective material because only the external friction surfaces and other exposed areas have to be made of a wear-resistant material. The cam's revolution prevents the tappet from executing an absolutely linear stroke, and it will tilt to some extent. As a result, the stress along the friction surfaces of the hollow-cylinder component will vary axially. Most exposed to wear is the surface area nearest the cam. The second most exposed to wear is the axial surface area most remote from the cam. The least wear occurs between these two points.

The annular guide can be made of a highly wear-resistant polymer, a ceramic or a metal. If the guide is made of metal, it will be thin enough to ensure only a slight increase in the accelerating mass of the tappet.

The guide can have perforations for crimping onto the tappet housing. The guides are inserted in the tappet tool and coated with a light weight, or low specific gravity, and cost effective plastic. Such a plastic will strengthen the tappet and the ring will ensure wear resistance and hence satisfactory long term operation. The plastic that the basic tappet is made of will completely occupy the perforations in the guide and will secure it against thrust by both interlocking and adhesion. The annular guide in other embodiments, however, can snap into a groove in the tappet housing or be cemented to it. Since such a guide can be inserted into the tappet housing later, the housing will be especially simple and cost effective to manufacture separately.

To facilitate lubrication of the mutually contacting friction surfaces of the bore in the cylinder head and of the annular guide on the tappet, the tappet housing and/or the guide can have lubricant depressions that open radially outwardly.

The preferred embodiments of the present invention will now be described with reference to the drawings.

DESCRIPTION OF THE PREFERRED EMBODIMENTS

The preferred embodiments of the present invention will now be described with reference to FIGS. 1–7 of the drawings. FIGS. 1–3 and 5–7 illustrate valve tappets for an internal combustion engine with an essentially cup shaped housing that fits over the shaft of a valve (not shown). The housing in each case is at least partly made of a plastic polymer.

Figure 1:
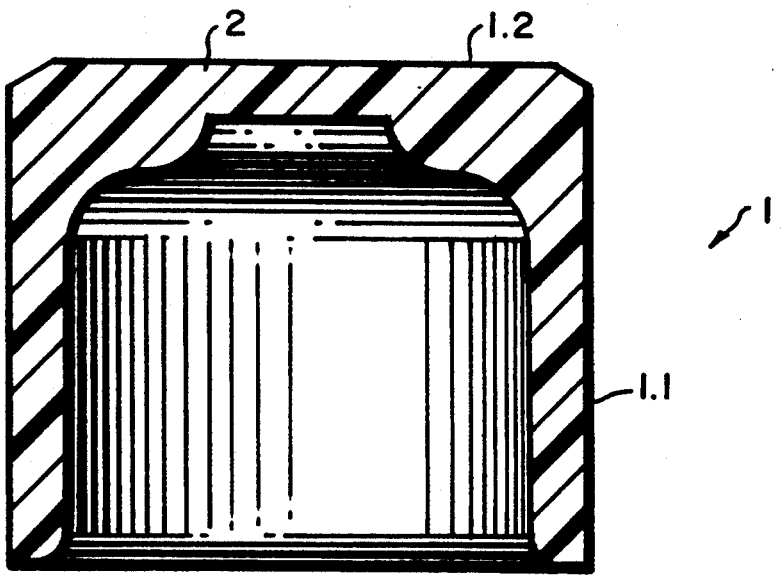
FIG. 1 is a axial cross-sectional view through a light weight, open cup shaped tappet without hydraulic valve clearance compensation in accordance with a first preferred embodiment of the present invention.

The cup-shaped tappet illustrated in FIG. 1 is open and lacks hydraulic valve-clearance compensation. Its housing 1 is entirely made of a plastic polymer and is particularly simple and easy to manufacture. The radial friction surface 1.1 of the illustrated embodiment is in one piece with the axial friction surface 1.2 on the base 2 of housing 1. Depending on the stresses encountered in the particular application and on the availability of low-cost materials, it is possible to make this tappet entirely of a particularly wear resistant polymer. It is also possible to manufacture the tappet housing with a particularly light weight and cost effective polymer plasma coating to make it more resistant to wear. Such designs are outstanding for lightness of weight and absolute ease of manufacture.

Figure 2:
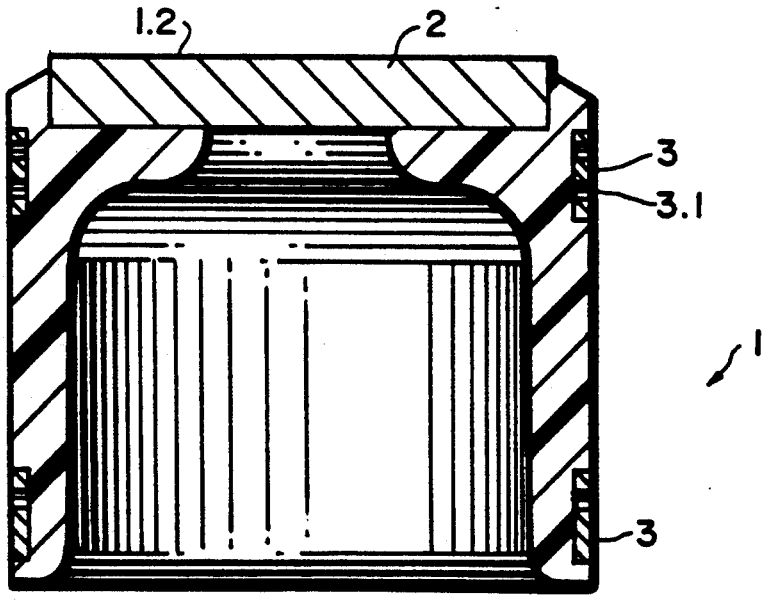
FIG. 2 is a axial cross-sectional view through a light weight, open cup shaped tappet without hydraulic valve clearance compensation in accordance with a second preferred embodiment of the present invention.

FIG. 2 illustrates a light-weight open-cup shaped tappet housing without hydraulic valve-clearance compensation. Housing 1 is in two parts. The axial contact surface 1.2 is a base 2 of metal or ceramic. The highly stressed sections of the radial friction surface 1.1 comprise annular guides 3 the around housing 1. This tappet has two sections of higher stress. The most highly stressed areas are, due to the tilting moment exerted by the revolving cam, nearest to and farthest from base the 2. Between these areas the stress is less severe. Like the tappet of FIG. 1, this tappet is lighter in weight than known tappets because its housing 1 is made of a light-weight polymer. Annular guides 3 can, like base the 2, be made of metal or ceramic, for example, or of a polymer that will maintain satisfactory operating properties over a long life. Even when particularly expensive or denser and hence heavier materials are employed, the tappet as a whole will hardly be any heavier because so little material is employed.

Figure 3:
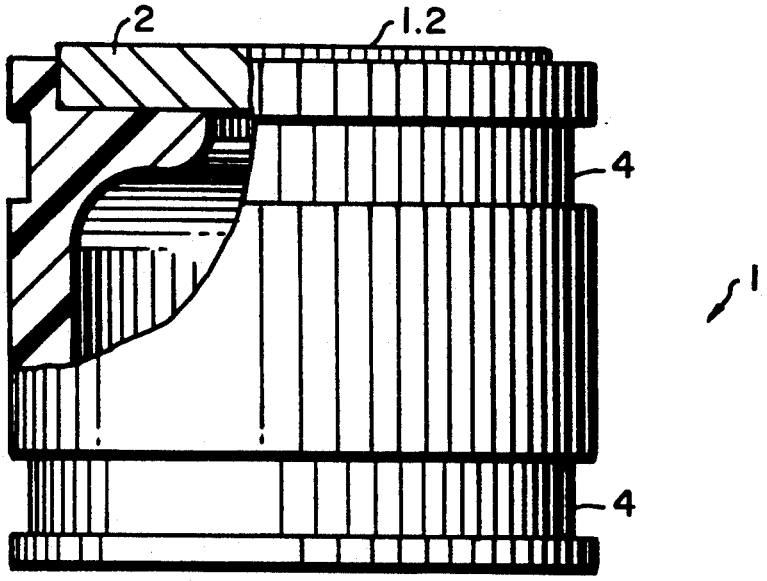
FIG. 3 is a axial cross-sectional view through a light weight, open cup shaped tappet without hydraulic valve clearance compensation in accordance with a third preferred embodiment of the present invention.

FIG. 3 illustrates a tappet housing 1 with a base 2 inserted into it. Particularly evident in this figure are the grooves 4 for the annular guides 3 illustrated in FIG. 2. The guides can snap and/or be cemented into the grooves.

Figure 4:
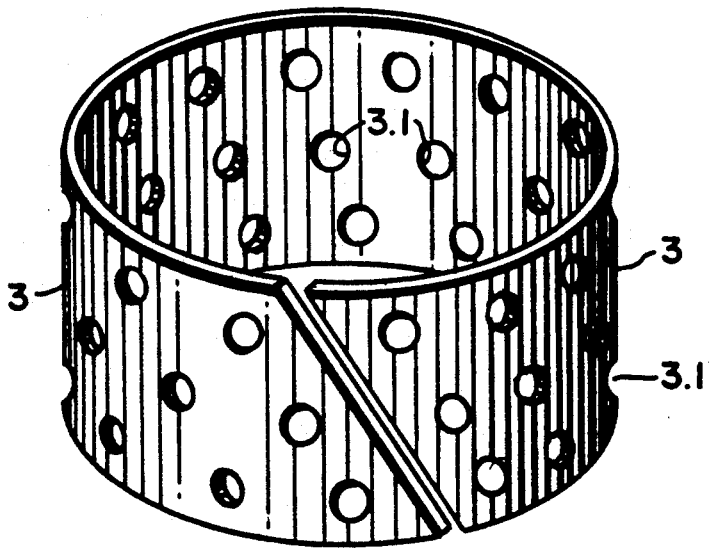
FIG. 4 is a perspective view of an annular guide which may be employed in the embodiments of FIG. 2 and FIG. 3.

An annular guide 3 of the type illustrated in FIG. 2 is illustrated by itself in FIG. 4. It has perforations 3.1, which can be round for example. Such a guide can easily be inserted into the tappet tool and have a cost-effective light-weight plastic injection-molded around it. Such a procedure will strengthen the tappet without detriment to its resistance to wear and will accordingly prolong its life. Such a guide consists of a particularly wear-resistant material, sheet metal for example, stamped out and rolled into an appropriate shape. The purpose of perforations 3.1 is to crimp the ring to the tappet housing. Such a tappet will transmit any thrusts that occur by both interlocking and adhesion.

Figure 5:
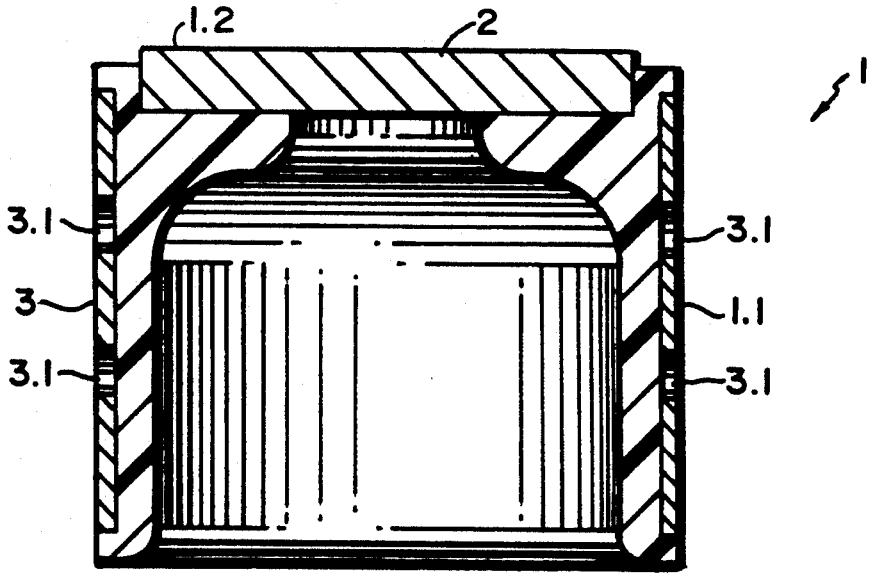
FIG. 5 is a axial cross-sectional view through a light weight, open cup shaped tappet without hydraulic valve clearance compensation in accordance with a fourth preferred embodiment of the present invention.

The tappet illustrated in FIG. 5 is similar to the one illustrated in FIG. 2. Its radial friction surface 1.1 is formed by a prefabricated plate similar in shape to the annular guide 3 illustrated in FIG. 4. The radial friction surface 1.1 of the plate 3 ca have perforations 3.1 forming lubricant pockets or be intact (smooth). As in the two-part tappets hereintofore described, the base 2 is secured to the housing 1 tightly enough to transmit both push and pull.

Figure 6:
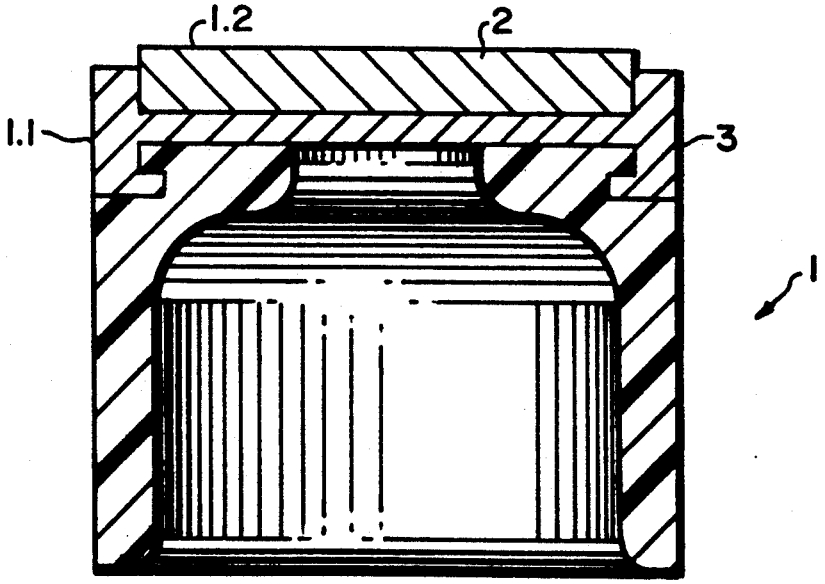
FIG. 6 is a axial cross-sectional view through a light weight, open cup shaped tappet without hydraulic valve clearance compensation in accordance with a fifth preferred embodiment of the present invention.

FIG. 6 illustrates a three-component cup-shaped tappet without hydraulic valve-clearance compensation. Radial friction surface 1.1 is formed by a disk 3. The disk axially accommodates both a metal or ceramic base 2 and a section of the axial friction surface that is less subjected to wear. The less subjected section interlocks with the more highly stressed section of the radial friction surface 1.1, which constitutes an annular guide in the sense of the invention.

Figure 7:
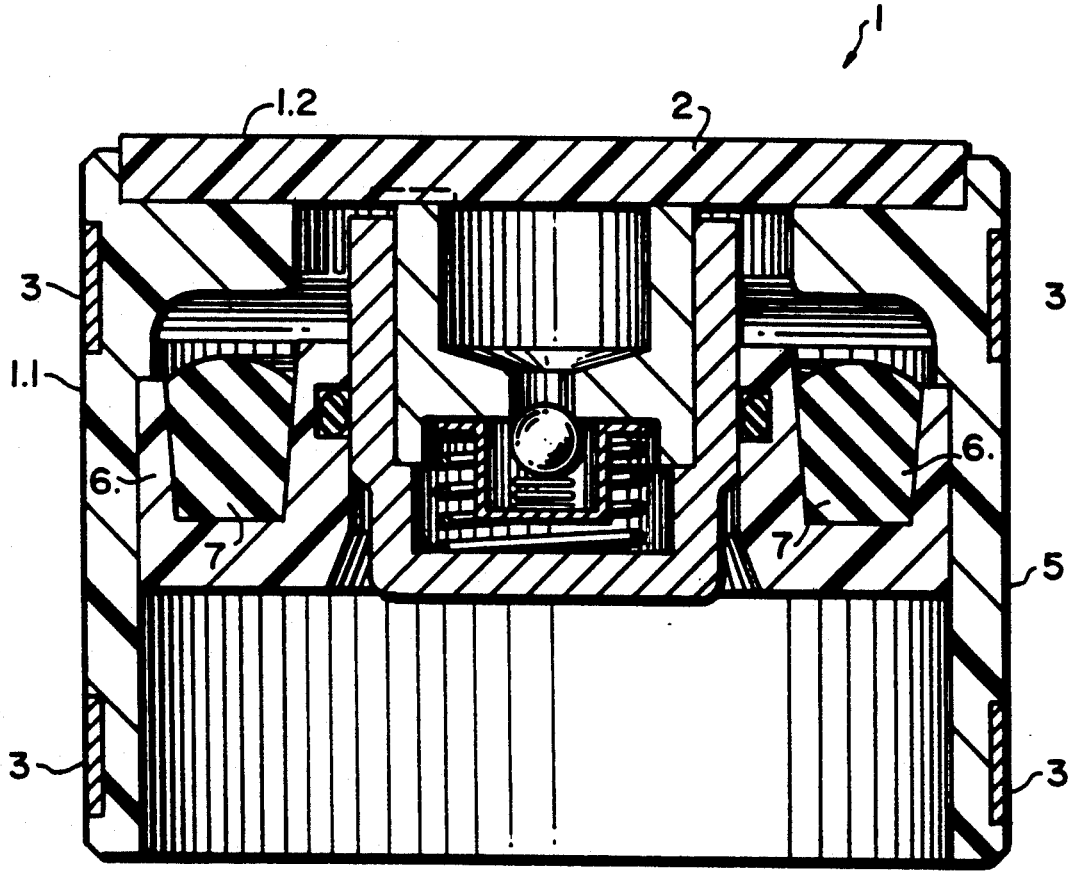
FIG. 7 is an axial cross-sectional view through a closed, cup shaped tappet with hydraulic valve clearance compensation in accordance with a sixth preferred embodiment of the present invention.

Additional grooves that accommodate additional annular guides can be positioned in the less stressed sections of the radial friction surface of another version of the tappet, which is not illustrated. FIG. 7 illustrates a closed cup-shaped tappet with hydraulic valve-clearance compensation. The radial friction surface 1.1 of the housing 1 has annular guides 3 in its more highly stressed sections. These guides lack perforations. Base 2 and positioner 5 are polymer. Positioner 5 accommodates a displacer 6 of closed-cell foam, polyurethane or silicone for example. Since such an embodiment has more individual moving parts than an open, cup-shaped tappet without hydraulic valve-clearance compensation, the material for each part is especially chosen from the aspect of weight reduction.

The components illustrated in FIGS. 1 through 7 are only examples, and their individual features can be combined in various ways. Plasma-coated, radial friction surfaces can be employed, for example, with metal or ceramic. All annular guides can, but need not have perforations and/or lubrication pockets.

The basic principle of the present invention is to employ various materials at various sites on the tappet as necessary to reduce its mass and accordingly either decrease the forces that occur in the valve mechanisms or increase the acceleration mass, improving the intake and efficiency of the internal combustion engine.

There has thus been shown and described a novel valve tappet that fulfills all the objects and advantages sought therefor. Many changes, modifications, variations, and other uses and applications of the subject invention will, however, become apparent to those skilled in the art after considering this specification and the accompanying drawings, which disclose the preferred embodiments thereof. All such changes, modifications, variations, and other uses and applications that do not depart from the spirit and scope of the invention are deemed to be covered by the invention, which is to be limited only by the claims that follow.

What is claimed is:

1. In a tappet for a valve with a valve shaft in an internal combustion engine, said tappet comprising an essentially cup-shaped housing, having a base and a skirt portion, that fits over the valve shaft, wherein at least the skirt portion of the tappet housing is made of a plastic polymer, the improvement wherein the tappet housing has at least one annular guide surrounding said skirt portion, said annular guide being made of a highly wear-resistant material to reduce wear of the tappet housing 2. The tappet defined in claim 1, wherein the outside of the tappet housing has plasma-coated radial friction surfaces.

3. The tappet defined in claim 1, wherein the outside of the tappet housing has plasma-coated axial friction surfaces.

4. The tappet defined in claim 1, wherein the tappet housing includes a separate metal base.

5. The tappet defined in claim 1, wherein the tappet housing includes a separate ceramic base.

6. The tappet defined in claim, 1, wherein the tappet housing has lubricant pockets that open radially out.

7. The tappet defined in claim 1, wherein the annular guide is a highly wear-resistant plastic polymer.

8. The tappet defined in claim 1, wherein the annular guide is made of metal.

9. The tappet defined in claim 1, wherein the annular guide is made of ceramic.

10. The tappet defined in claim 1, wherein the annular guide has perforations for crimping onto the tappet housing.

11. The tappet defined in claim 1, wherein the annular guide snaps into a groove in the tappet housing.

12. The tappet defined in claim 1, wherein the annular guide is cemented to the tappet housing.

13. The tappet defined in claim 1, wherein the annular guide has lubricant pockets that open radially out.

* * * * *